US012527407B2

(12) United States Patent
Leng

(10) Patent No.: US 12,527,407 B2
(45) Date of Patent: Jan. 20, 2026

(54) LOWER SIDE BED FRAME OF DOUBLE-LAYER IRON FRAME BED

(71) Applicant: Luhao Leng, Xiamen (CN)

(72) Inventor: Luhao Leng, Xiamen (CN)

( * ) Notice: Subject to any disclaimer, the term of this patent is extended or adjusted under 35 U.S.C. 154(b) by 543 days.

(21) Appl. No.: 17/967,256

(22) Filed: Oct. 17, 2022

(65) Prior Publication Data

US 2023/0404272 A1 Dec. 21, 2023

(51) Int. Cl.
*A47C 19/02* (2006.01)

(52) U.S. Cl.
CPC ..... *A47C 19/021* (2013.01)

(58) Field of Classification Search
CPC ..... A47C 19/021; A47C 19/122; A47C 19/20; A47C 19/005
USPC ..... 5/131
See application file for complete search history.

(56) References Cited

U.S. PATENT DOCUMENTS 1,694,885 A * 12/1928 Matheson ..... F16B 12/56 16/374
3,226,736 A 1/1966 Krieger
3,590,753 A 7/1971 Blink et al.
3,748,668 A 7/1973 Rudin
3,754,728 A 8/1973 Bowman
5,165,638 A 11/1992 Fallon et al.
2002/0136591 A1 9/2002 Callahan
2005/0278849 A1* 12/2005 Polevoy ..... A47C 19/024 5/310
2009/0271924 A1* 11/2009 Leng ..... A47C 19/005 5/200.1
2010/0180379 A1* 7/2010 Leng ..... A47C 21/08 5/425
2016/0206110 A1* 7/2016 Oh ..... A47C 19/12
2017/0188716 A1* 7/2017 Leng ..... A47C 19/202
2017/0208955 A1* 7/2017 Lee ..... A47C 19/025
2018/0055235 A1* 3/2018 Choi ..... A47C 19/12
2018/0110339 A1* 4/2018 Moon ..... A47C 19/122
2018/0125255 A1* 5/2018 Jin ..... A47C 19/024
2018/0360225 A1* 12/2018 Leng ..... A47C 19/028
2019/0024691 A1* 1/2019 Leng ..... A47C 19/202

(Continued)

OTHER PUBLICATIONS

Non-Final Office Action cited in U.S. Appl. No. 17/967,966 mailed Jan. 16, 2025, 19 pages.

(Continued)

*Primary Examiner* — Amber R Anderson
*Assistant Examiner* — Luke Hall
(74) *Attorney, Agent, or Firm* — Cooper Legal Group, LLC

(57) ABSTRACT

A lower side bed frame of a double-layer iron frame bed comprises two transverse rods, two longitudinal rods, and four columns. An upper end of a lower column comprises a joint section formed by reducing a diameter. An upper column is sleeved on the joint section. An end surface of each of the two transverse rods is connected with a locking piece, and the locking piece abuts outer sides of the upper column and the lower column. An upper bolt enables the locking piece, the upper column, and the joint section to be locked together. A lower bolt enables the locking piece and the lower column to be locked together. Two supporting feet are located below a middle position of the two transverse rods. A connecting rod is connected between the two supporting feet and pulls the two supporting feet in a longitudinal direction.

15 Claims, 6 Drawing Sheets

(56) References Cited

U.S. PATENT DOCUMENTS

| | | | | |
|---|---|---|---|---|
| 2019/0142175 | A1 | 5/2019 | Cantrell | |
| 2019/0343291 | A1 | 11/2019 | Avegno | |
| 2020/0018337 | A1* | 1/2020 | Niederkofler | A47C 19/005 |
| 2020/0375367 | A1* | 12/2020 | Qiu | A47C 19/005 |
| 2020/0390233 | A1* | 12/2020 | Leng | A47B 3/0915 |
| 2022/0061540 | A1 | 3/2022 | Ermalovich et al. | |

OTHER PUBLICATIONS

Non-Final Office Action cited in U.S. Appl. No. 17/967,190 mailed Jan. 21, 2025, 11 pages.
Final Office Action cited in U.S. Appl. No. 17/967,190 mailed May 23, 2025, 26 pages.

* cited by examiner

LOWER SIDE BED FRAME OF DOUBLE-LAYER IRON FRAME BED

RELATED APPLICATIONS

This application claims priority to Chinese patent application number 202221206765.7, filed on May 19, 2022. Chinese patent application number 202221206765.7 is incorporated herein by reference.

FIELD OF THE DISCLOSURE

The present disclosure relates to an iron frame bed, and in particular to a lower side bed frame of a double-layer iron frame bed.

BACKGROUND OF THE DISCLOSURE

A double-layer iron frame bed has an upper bunk and a lower bunk. The double-layer iron frame bed has a large height and a high center of gravity, so stability of the double-layer iron frame bed is relatively weak. Compared with an upper bed frame of the upper bunk, a lower bed frame of the lower bunk has a larger load. The overall stability of the lower bed frame plays a decisive role.

At present, in a structure of the lower bed frame, a connection between a column and a transverse bar adopts a hooking connection. In this way, the transverse bar shakes violently. In other embodiments, bolts are also used for locking the column and the transverse bar. Except for installation between an upper column and a lower column of the column, the transverse bar and the column should also be locked with bolts. The installation is troublesome, and the upper column, the lower column, and the transverse bar are connected independently of one another, causing strength to be limited. In addition, in the structure of the lower bed frame, a length of the transverse bar is larger than that of a longitudinal bar so that the transverse bar must bear greater torsion during use. In order to improve strength of the transverse bar, adding a supporting foot below a middle positon of the transverse bar is an effective means. However, when consumers use the double-layer iron frame bed daily, the consumers easily kick the supporting foot, and the supporting foot can be kicked crookedly with a small force, so that the supporting foot cannot play a very good supporting role and can even drive the transverse bar to twist.

In summary, the current stability of the lower bed frame needs to be improved.

BRIEF SUMMARY OF THE DISCLOSURE

The present disclosure provides a lower side bed frame of a double-layer iron frame bed, which has better strength and stability. A technical solution of the present disclosure is as follows.

A lower side bed frame of a double-layer iron frame bed comprises two transverse rods symmetrically parallel to each other in a front-and-rear direction, two longitudinal rods symmetrically parallel to each other in a left-and-right direction, four columns arranged vertically, two supporting feet, and a connecting rod for connecting the two supporting feet. The two longitudinal rods and the two transverse rods form a rectangular frame, and the four columns are respectively connected to four corners of the rectangular frame. Each of the four columns comprises an upper column and a lower column that are configured be inserted together in an up-and-down direction. An upper end of the lower column comprises a joint section formed by reducing a diameter of the upper end of the lower column. The upper column is sleeved on the joint section. An end portion of each of the two longitudinal rods is fixedly connected to the lower column. An end surface of each of the two transverse rods is connected with a locking piece, and the locking piece is configured to abut an outer side of the upper column and an outer side of the lower column. A first portion of the locking piece extending upwardly beyond an upper surface of each of the two transverse rods is locked with an upper bolt, and the upper bolt enables the locking piece, the upper column, and the joint section to be locked together. A second portion of the locking piece extending downward beyond a lower surface of each of the two transverse rods is locked with a lower bolt, and the lower bolt enables the locking piece and the lower column to be locked together. The two supporting feet are matched with the two transverse rods in a one-to-one correspondence. The two supporting feet are located below a middle position of the two transverse rods. The connecting rod is connected between the two supporting feet and is configured to pull the two supporting feet in a longitudinal direction of the lower side bed frame. End portions of the connecting rod are detachably insertion-connected with the two supporting feet.

The locking piece abuts the outer side of the upper column and the outer side of the lower column at the same time, and the upper bolt and the lower bolt firmly lock the three parts of the upper column, the lower column, and a transverse rod of the two transverse rods together to form a solid T-shaped structure, which does not shake, has few bolts, and is very convenient for consumers to assemble. At the same time, the two supporting feet can improve a supporting force applied by the two transverse rods. The two supporting feet are connected by the connecting rod, and a distance between the two supporting feet remains fixed. The two supporting feet and the connecting rod form an H-shaped bracket structure, which improves stability of the two supporting feet, so that the two supporting feet have a good ability to resist deformation and impact, effectively preventing a user from easily kicking the two supporting feet to cause the two supporting feet to become crooked.

In a preferred embodiment, the upper column is further locked with a reinforcing bolt, and the reinforcing bolt enables the upper column and the joint section to be locked together. The reinforcing bolt is located above the upper bolt. The reinforcing bolt can increase connection strength of the upper column and the lower column, which has a good effect on stability of the upper column and can bring better stability to an upper bunk.

In a preferred embodiment, the lower column is disposed with pull rivets respectively corresponding to the upper bolt, the lower bolt, and the reinforcing bolt. The lower column is directly disposed with the pull rivets, which is conducive to the installation of the bolts.

In a preferred embodiment, the locking piece is arc-shaped to correspond to a shape of the outer side of the upper column and a shape of the outer side of the lower column. Therefore, the locking piece can better fit an outer side of each of the four columns, and a contact area on the outer side of each of the four columns is large.

In a preferred embodiment, a left side and a right side of the locking piece respectively comprises a folded edge folded toward a corresponding one of the two transverse rods. The folded edge has a function of position limiting so that the connection and assembly between the end surface of each of the two transverse rods and the locking piece is more convenient.

In a preferred embodiment, a top end of each of the two supporting feet is connected with a connecting seat, and the connecting seat is connected with a corresponding one of the two transverse rods. Each of the two transverse rods comprises two transverse rod units configured to be spliced together. An inner end of each of the two transverse rod units is pivotally connected to the connecting seat so that each of the two transverse rods is configured to be folded in half using a corresponding one of the two supporting feet as a center line. The two transverse rod units are pivotally connected to the connecting seat at the top end of each of the two supporting feet respectively, so that each of the two transverse rods can be folded, which is convenient for packaging and transportation. At the same time, after each of the two transverse rods is unfolded, the two supporting feet are located in the middle position of each of the two transverse rods, which can improve the supporting force applied by each of the two transverse rods.

In a preferred embodiment, an end surface of the connecting rod comprises a U-shaped steel groove corresponding to a corresponding one of the two supporting feet. The U-shaped steel groove is clamped to the corresponding one of the two supporting feet. A tongue piece protrudes from bottom surface of the U-shaped steel groove. The corresponding one of the two supporting feet comprises a buckle opening. The tongue piece is configured to be inserted into the buckle opening. The U-shaped steel groove clamps the two supporting feet, and the structure is stable.

In a preferred embodiment, an upper edge of the tongue piece is connected to the bottom surface of the U-shaped steel groove, and the tongue piece is configured to be inserted into a lower edge of the buckle opening due to gravity. That is to say, the tongue piece cooperates with the buckle opening to realize the buckle-hooking connection between the U-shaped steel groove and the two supporting feet. Therefore, a distance between the two supporting feet cannot be reduced due to the existence of the connecting rod, and because of the connection between the tongue piece and the buckle opening, the distance between the two support feet cannot be enlarged. That is, the connecting rod can pull the two supporting feet in the longitudinal direction, so as to ensure that the supporting feet will not be inclined due to a large impact.

In a preferred embodiment, the connecting seat comprises a seat plate and two side plates. The top end of each of the two supporting feet is connected with the seat plate, and the two side plates are symmetrically connected to two sides of the seat plate. A part of each of the two side plates extending out of the seat plate is pivotally connected with the two transverse rod units, and the two supporting feet are disposed between the two transverse rod units when the two transverse rods are folded. The two side plates are longer than the seat plate, and the two side plates are pivotally connected to the two transverse rod units at the part of the side plate extending out of the seat plate. This structural design can better enable the two transverse rod units to be folded in half with one of the two supporting feet as the center line, so as to enable the two transverse rods to be more cleanly arranged after folding.

In a preferred embodiment, the lower side bed frame further comprises two or three longitudinal bed beams, and the two or three longitudinal bed beams are connected between the two transverse rods to pull the two transverse rods in the longitudinal direction. An inner side of each of the two transverse rods is disposed with buckle seats for buckle connection to the two or three longitudinal bed beams, and the two or three longitudinal bed beams are evenly spaced apart from one another. The two or three longitudinal bed beams can pull the two transverse rods bars in the longitudinal direction to improve the stability of the lower side bed frame.

DETAILED DESCRIPTION OF THE EMBODIMENTS

The present disclosure will be further described below in combination with the accompanying drawings and embodiments.

Figure 1:
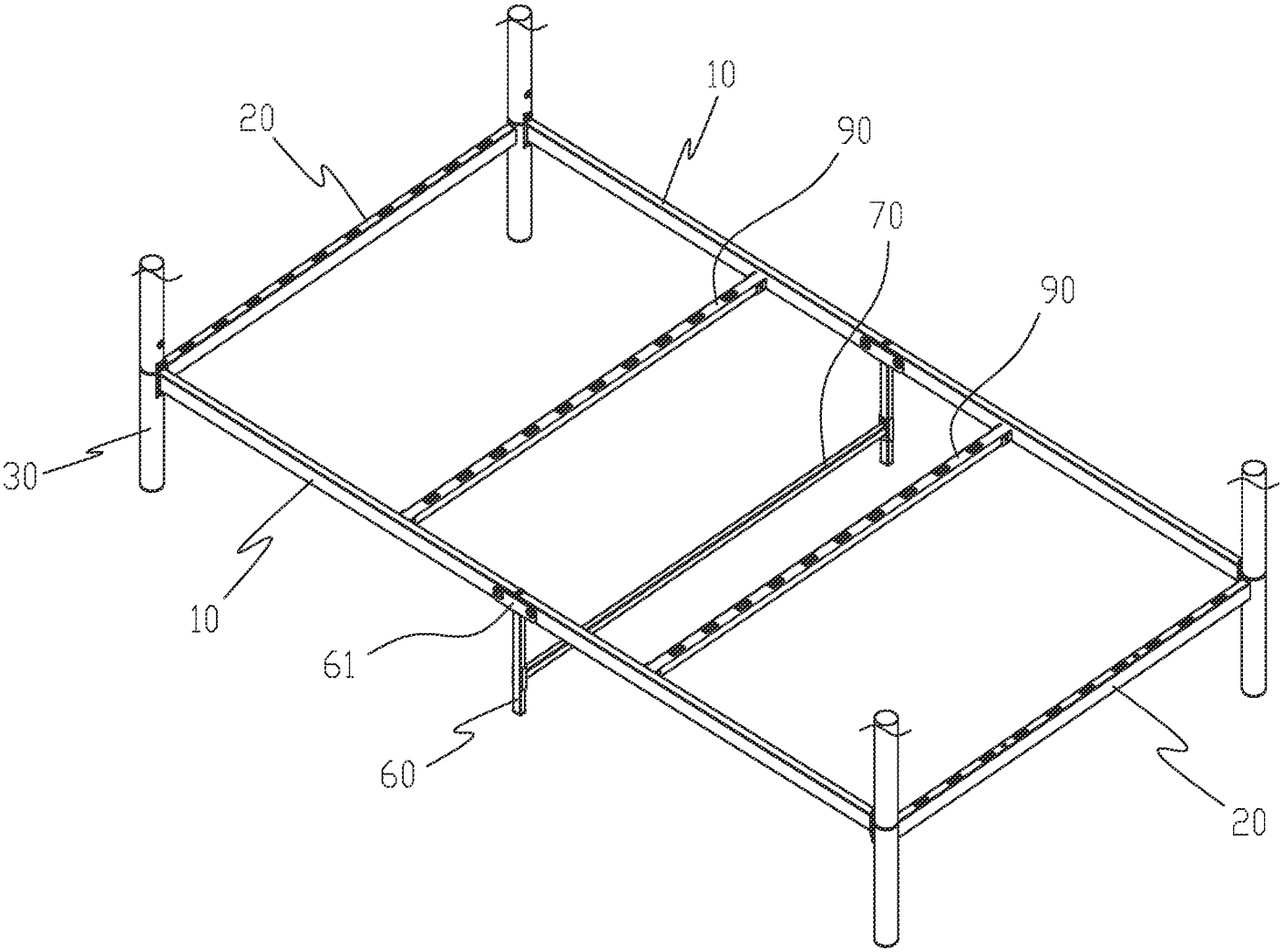
FIG. 1 illustrates a perspective view of a lower side bed frame of a double-layer iron frame bed.
Figure 2:
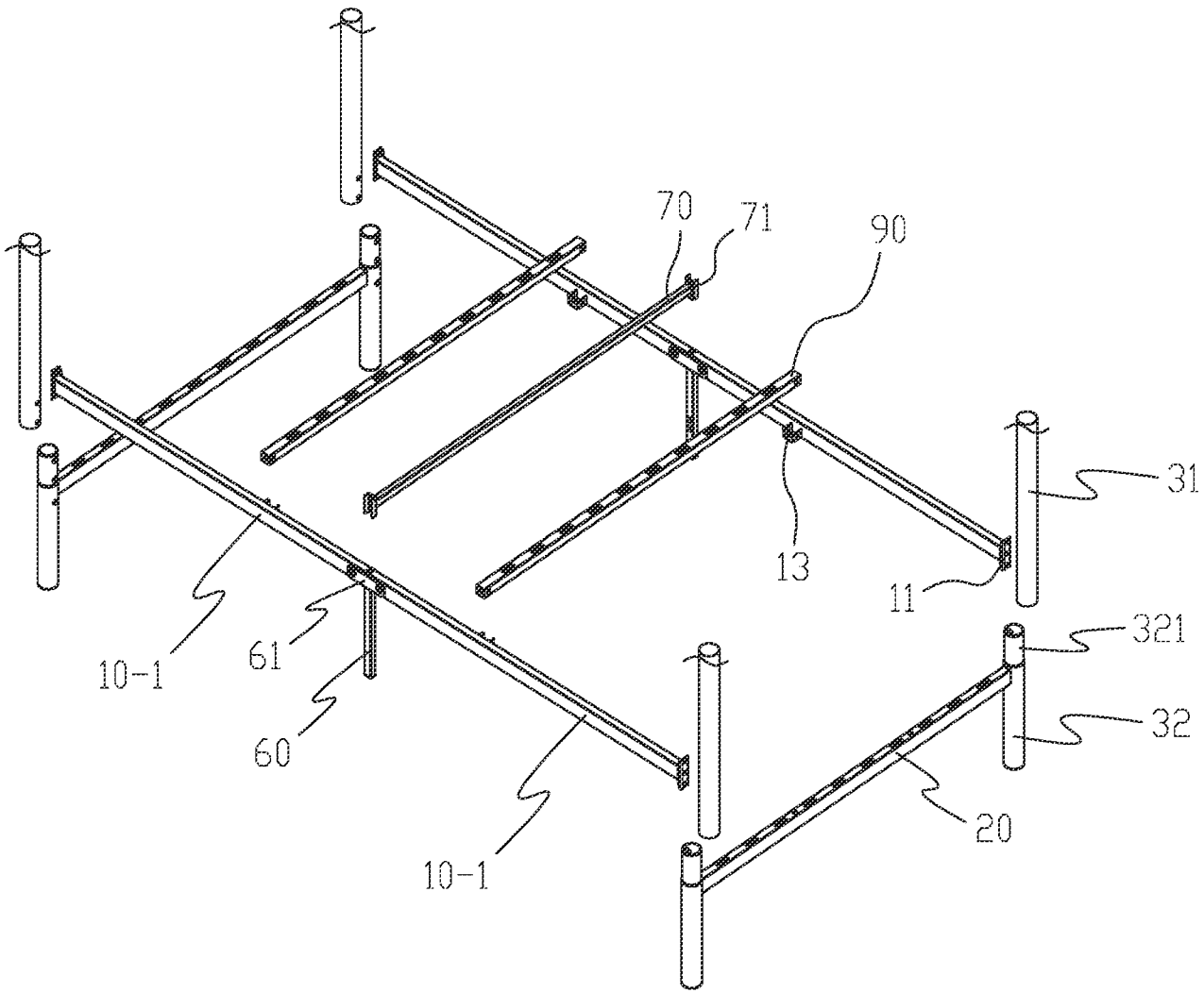
FIG. 2 illustrates an exploded view of the lower side bed frame of the double-layer iron frame bed in FIG. 1.
Figure 3:
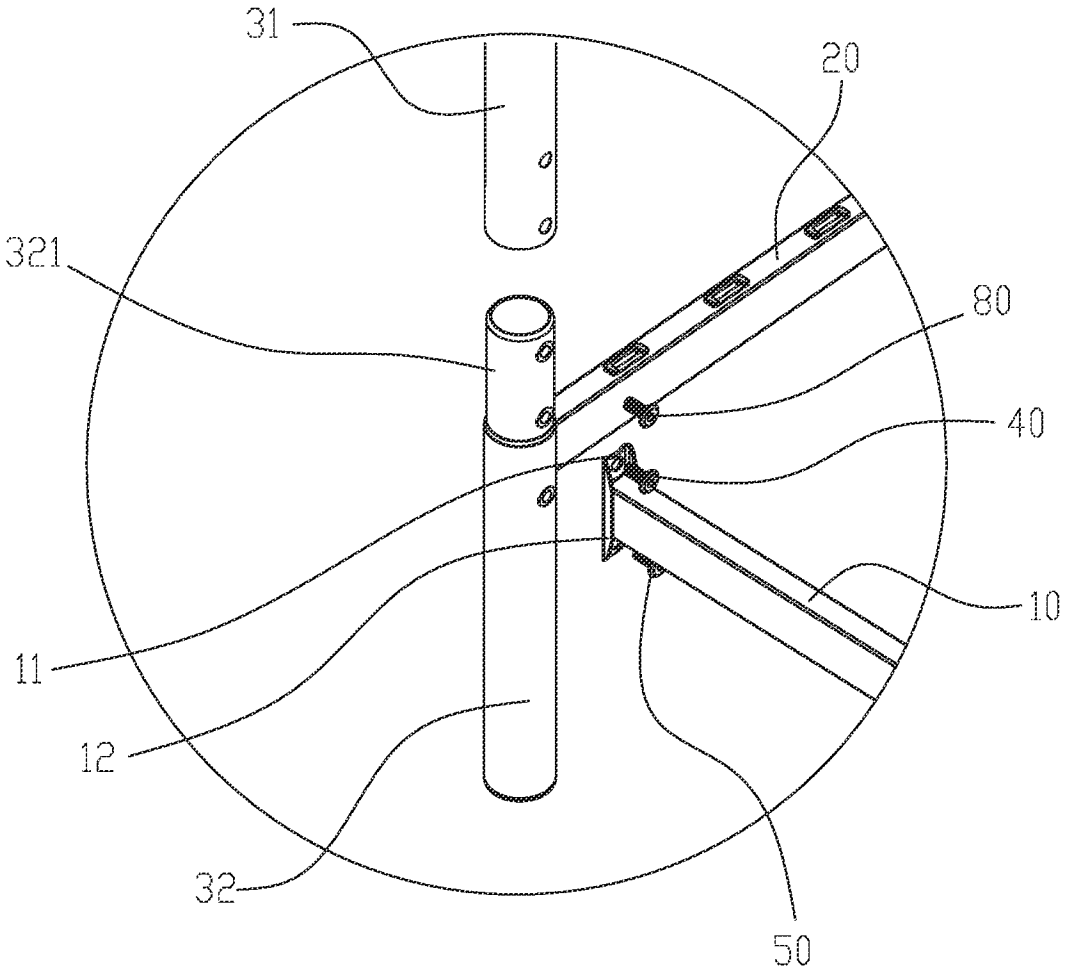
FIG. 3 illustrates an enlarged view of one of four columns, one of two transverse rods, and one of two longitudinal rods in an exploded state in FIG. 1.
Figure 4:
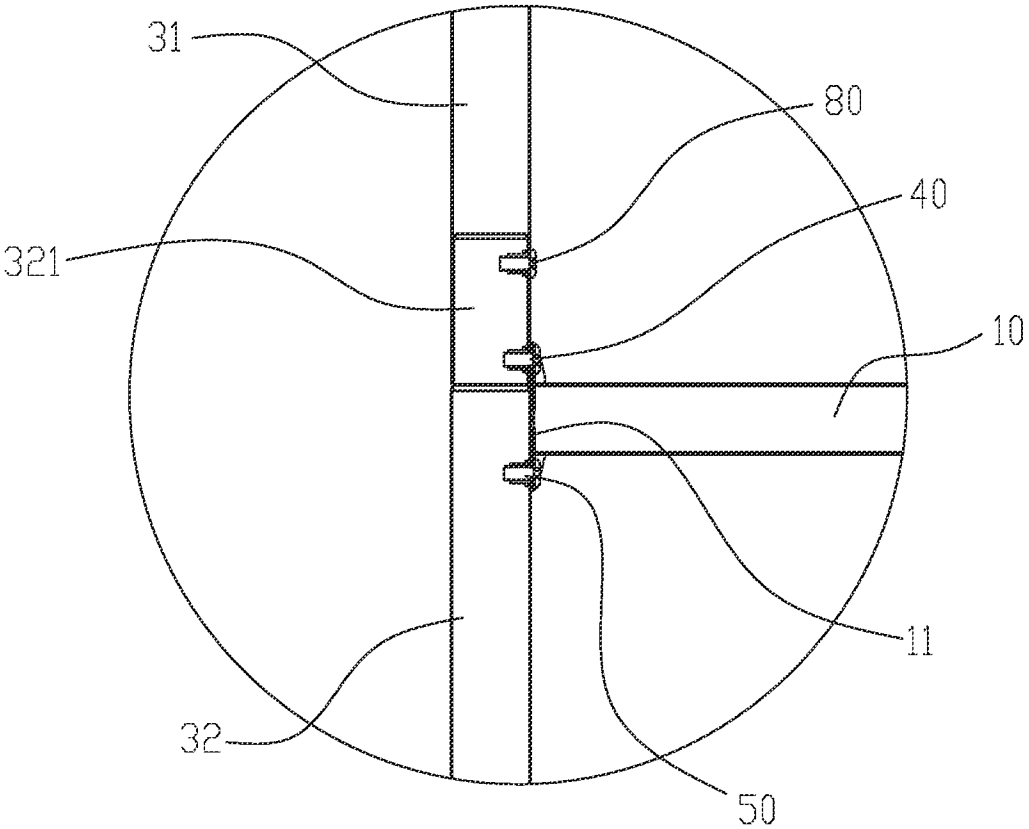
FIG. 4 illustrates an enlarged cross-sectional view of one of the four columns, one of the two transverse rods, and one of the two longitudinal rods in an assembled state in FIG. 1.
Figure 5:
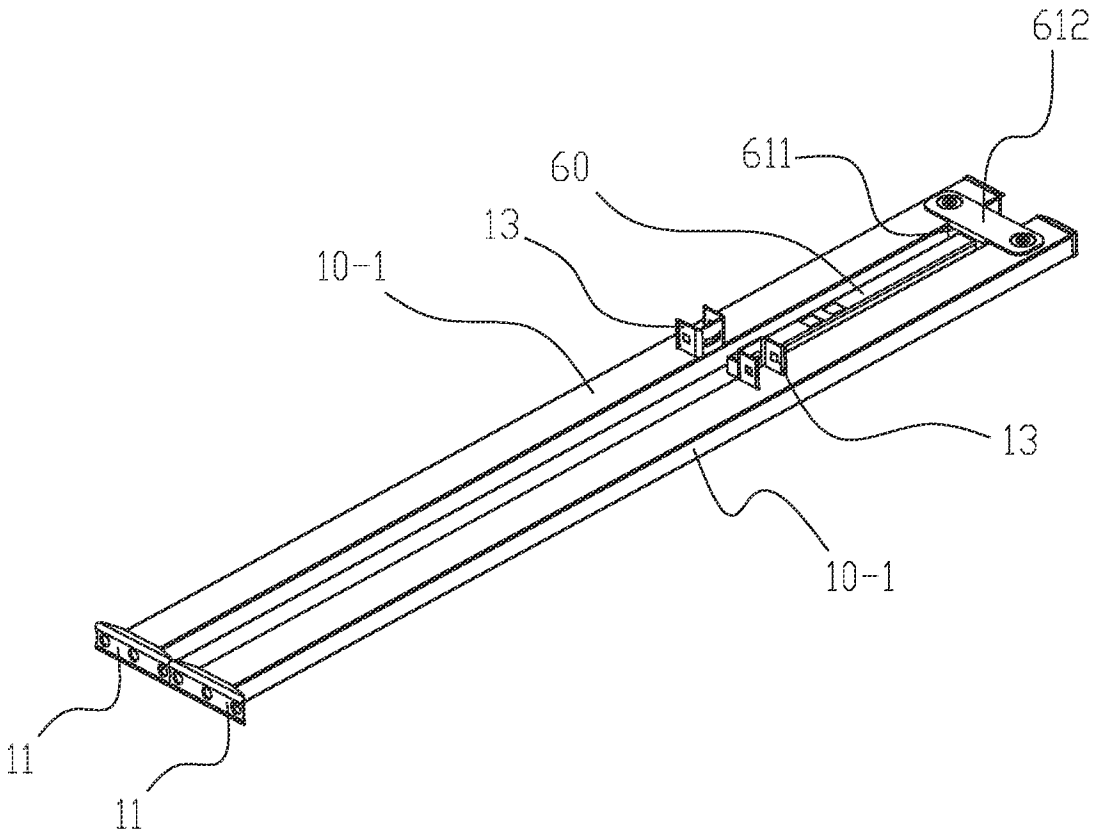
FIG. 5 illustrates a perspective view of one of the transverse rods and one of two supporting feet in a folded state in FIG. 1.
Figure 7:
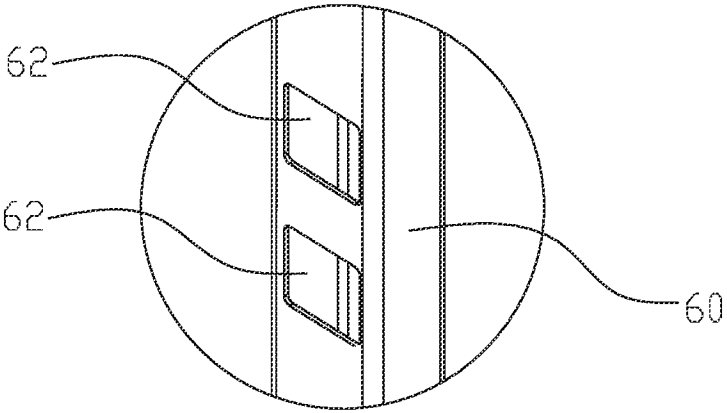
FIG. 7 illustrates a partially enlarged perspective view of one of the two supporting feet in FIG. 1.
Figure 6:
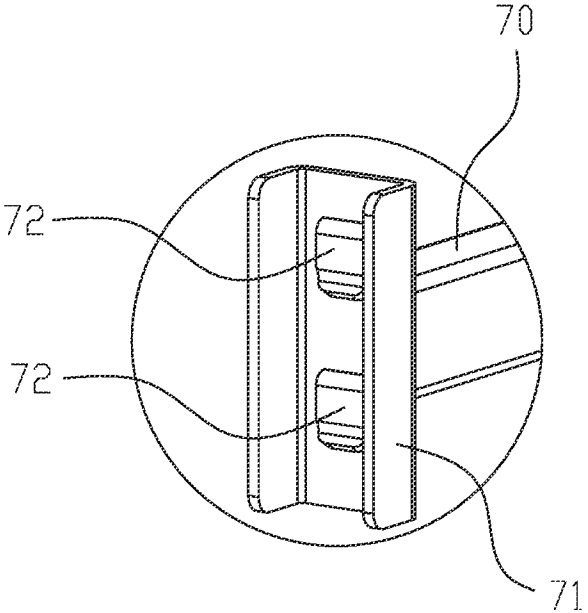
FIG. 6 illustrates a partially enlarged perspective view of an end surface of a connecting rod in FIG. 1.

Referring to FIGS. 1 to 7, a lower side bed frame of a double-layer iron frame bed comprises two transverse rods 10 symmetrically parallel to each other in a front-and-rear direction, two longitudinal rods 20 symmetrically parallel to each other in a left-and-right direction, and four columns 30 arranged vertically. The two longitudinal rods 20 and the two transverse rods 10 form a rectangular frame, and the four columns 30 are respectively connected to four corners of the rectangular frame. Each of the four columns 30 comprises an upper column 31 and a lower column 32 that can be inserted together in an up-and-down direction. An upper end of the lower column 32 comprises a joint section 321 formed by reducing a diameter of the upper end of the lower column 32, and the upper column 31 is sleeved on the joint section 321. An end portion of each of the two longitudinal rods 20 is fixedly connected (welded in this embodiment) to the lower column 32. An end surface of each of the two transverse rods 10 is connected with a locking piece 11, and the locking piece 11 is configured to abut an outer side of the upper column 31 and an outer side of the lower column 32. A first portion of the locking piece 11 extending upwardly beyond an upper surface of each of the two transverse rods 10 is locked with an upper bolt 40, and the upper bolt 40 enables the locking piece 11, the upper column 31, and the joint section 321 to be locked together. A second portion of the locking piece 11 extending downward beyond a lower surface of each of the two transverse rods 10 is locked with a lower bolt 50, and the lower bolt 50 enables the locking piece 11 and the lower column 32 to be locked together. The lower side bed frame of the double-layer iron frame bed further comprises two supporting feet 60 and a connecting rod 70 for connecting the two supporting feet 60. The two supporting feet 60 are matched with the two transverse rods 10 in a one-to-one correspondence. The two supporting feet 60 are located below a middle position of the two transverse rods 10, and the connecting rod 70 is connected between the two supporting feet 60 and is configured to pull the two supporting feet 60 in a longitudinal direction of the lower side bed frame (i.e., the front-and-rear direction). End portions of the connecting rod 70 are detachably insertion-connected with the two supporting feet 60.

Preferably, the upper column 31 is further locked with a reinforcing bolt 80. The reinforcing bolt 80 enables the upper column 31 and the joint section 321 to be locked together, and the reinforcing bolt 80 is located above the upper bolt 40.

Preferably, the lower column 32 is disposed with pull rivets respectively corresponding to the upper bolt 40, the lower bolt 50, and the reinforcing bolt 80.

Preferably, the locking piece 11 is arc-shaped to correspond to a shape of the outer side of the upper column 31 and a shape of the outer side of the lower column 32.

Preferably, a left side and a right side of the locking piece 11 respectively comprises a folded edge 12 folded toward a corresponding one of the two transverse rods 10.

Preferably, a top end of each of the two supporting feet 60 is connected with a connecting seat 61, and the connecting seat 61 is connected with a corresponding one of the two transverse rods 10. Each of the two transverse rods 10 comprises two transverse rod units 10-1 spliced together. An inner end of each of the two transverse rod units 10-1 is pivotally connected to the connecting seat 61, so that each of the two transverse rods 10 can be folded in half using a corresponding one of the two supporting feet 60 as a center line.

Preferably, an end surface of the connecting rod 70 comprises a U-shaped steel groove 71 corresponding to a corresponding one of the two supporting feet 60. The U-shaped steel groove 71 is clamped to the corresponding one of the two supporting feet 60. A tongue piece 72 protrudes from a bottom surface of the U-shaped steel groove 71, the corresponding one of the two supporting feet 60 comprises a buckle opening 62, and the tongue piece 72 is inserted into the buckle opening 62.

Preferably, an upper edge of the tongue piece 72 is connected to the bottom surface of the U-shaped steel groove 71, and the tongue piece 72 is inserted into a lower edge of the buckle opening 62 due to gravity.

Preferably, the connecting seat 61 comprises a seat plate 611 and two side plates 612, and the top end of each of the two supporting feet 60 is connected with the seat plate 611. The two side plates 612 are symmetrically connected to two sides of the seat plate 611. A part of each of the two side plates 612 extending out of the seat plate 611 is pivotally connected with the two transverse rod units 10-1, and the two supporting feet 60 are disposed between the two transverse rod units 10-1 when the two transverse rods 10 are folded.

Preferably, the lower side bed frame further comprises two or three longitudinal bed beams 90, and the two or three longitudinal bed beams 90 are connected between the two transverse rods 10 to pull the two transverse rods 10 in the longitudinal direction. An inner side of each of the two transverse rods 10 is disposed with buckle seats 13 for buckle connection to the two or three longitudinal bed beams 90. The two or three longitudinal bed beams 90 are evenly spaced apart from one another.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A lower side bed frame of a double-layer iron frame bed, comprising:

two transverse rods symmetrically parallel to each other in a front-and-rear direction, two longitudinal rods symmetrically parallel to each other in a left-and-right direction, four columns arranged vertically, two supporting feet, and a connecting rod for connecting the two supporting feet, wherein:

the two longitudinal rods and the two transverse rods form a rectangular frame, the four columns are respectively connected to four corners of the rectangular frame, each of the four columns comprises an upper column and a lower column that are configured be inserted together in an up-and-down direction, an upper end of the lower column comprises a joint section formed by reducing a diameter of the upper end of the lower column, the upper column is sleeved on the joint section, an end portion of each of the two longitudinal rods is fixedly connected to the lower column, an end surface of each of the two transverse rods is connected with a locking piece, the locking piece is configured to abut an outer side of the upper column and an outer side of the lower column, a first portion of the locking piece extending upwardly beyond an upper surface of each of the two transverse rods is locked with an upper bolt, the upper bolt enables the locking piece, the upper column, and the joint section to be locked together, a second portion of the locking piece extending downward beyond a lower surface of each of the two transverse rods is locked with a lower bolt, the lower bolt enables the locking piece and the lower column to be locked together, the two supporting feet are matched with the two transverse rods in a one-to-one correspondence, the two supporting feet are located below a middle position of the two transverse rods, a top end of each of the two supporting feet is connected with a connecting seat, the connecting seat is connected with a corresponding one of the two transverse rods, the connecting rod is connected between middle portions of the two supporting feet and is configured to pull the two supporting feet in a longitudinal direction of the lower side bed frame when a force is applied to the connecting rod, and end portions of the connecting rod are detachably insertion-connected with the two supporting feet.

2. The lower side bed frame of the double-layer iron frame bed according to claim 1, wherein:

the upper column is further locked with a reinforcing bolt, the reinforcing bolt enables the upper column and the joint section to be locked together, and the reinforcing bolt is located above the upper bolt.

3. The lower side bed frame of the double-layer iron frame bed according to claim 2, wherein:

the lower column is disposed with pull rivets respectively corresponding to the upper bolt, the lower bolt, and the reinforcing bolt.

4. The lower side bed frame of the double-layer iron frame bed according to claim 1, wherein:

the locking piece is arc-shaped to correspond to a shape of the outer side of the upper column and a shape of the outer side of the lower column.

5. The lower side bed frame of the double-layer iron frame bed according to claim 1, wherein:

a left side and a right side of the locking piece respectively comprises a folded edge folded toward the corresponding one of the two transverse rods.

6. The lower side bed frame of the double-layer iron frame bed according to claim 1, wherein:

each of the two transverse rods comprises two transverse rod units configured to be spliced together, and an inner end of each of the two transverse rod units is pivotally connected to the connecting seat so that each of the two transverse rods is configured to be folded in half using a corresponding one of the two supporting feet as a center line.

7. The lower side bed frame of the double-layer iron frame bed according to claim 6, wherein:

the connecting seat comprises a seat plate and two side plates, the top end of each of the two supporting feet is connected with the seat plate, the two side plates are symmetrically connected to two sides of the seat plate, a part of each of the two side plates extending out of the seat plate is pivotally connected with the two transverse rod units, and the two supporting feet are disposed between the two transverse rod units when the two transverse rods are folded.

8. The lower side bed frame of the double-layer iron frame bed according to claim 6, wherein:

the lower side bed frame further comprises two or three longitudinal bed beams, the two or three longitudinal bed beams are connected between the two transverse rods to pull the two transverse rods in the longitudinal direction, an inner side of each of the two transverse rods is disposed with buckle seats for buckle connection to the two or three longitudinal bed beams, and the two or three longitudinal bed beams are evenly spaced apart from one another.

9. The lower side bed frame of the double-layer iron frame bed according to claim 7, wherein:

the lower side bed frame further comprises two or three longitudinal bed beams, the two or three longitudinal bed beams are connected between the two transverse rods to pull the two transverse rods in the longitudinal direction, an inner side of each of the two transverse rods is disposed with buckle seats for buckle connection to the two or three longitudinal bed beams, and the two or three longitudinal bed beams are evenly spaced apart from one another.

10. The lower side bed frame of the double-layer iron frame bed according to claim 6, wherein:

an end surface of the connecting rod comprises a U-shaped steel groove corresponding to a corresponding one of the two supporting feet, the U-shaped steel groove is clamped to the corresponding one of the two supporting feet, a tongue piece protrudes from a bottom surface of the U-shaped steel groove, the corresponding one of the two supporting feet comprises a buckle opening, and the tongue piece is configured to be inserted into the buckle opening.

11. The lower side bed frame of the double-layer iron frame bed according to claim 10, wherein:

an upper edge of the tongue piece is connected to the bottom surface of the U-shaped steel groove, and the tongue piece is configured to be inserted into a lower edge of the buckle opening due to gravity.

12. The lower side bed frame of the double-layer iron frame bed according to claim 1, wherein:

an end surface of the connecting rod comprises a U-shaped steel groove corresponding to a corresponding one of the two supporting feet, the U-shaped steel groove is clamped to the corresponding one of the two supporting feet, a tongue piece protrudes from a bottom surface of the U-shaped steel groove, the corresponding one of the two supporting feet comprises a buckle opening, and the tongue piece is configured to be inserted into the buckle opening.

13. The lower side bed frame of the double-layer iron frame bed according to claim 12, wherein:

an upper edge of the tongue piece is connected to the bottom surface of the U-shaped steel groove, and the tongue piece is configured to be inserted into a lower edge of the buckle opening due to gravity.

14. The lower side bed frame of the double-layer iron frame bed according to claim 1, wherein:

the lower side bed frame further comprises two or three longitudinal bed beams, the two or three longitudinal bed beams are connected between the two transverse rods to pull the two transverse rods in the longitudinal direction, an inner side of each of the two transverse rods is disposed with buckle seats for buckle connection to the two or three longitudinal bed beams, and the two or three longitudinal bed beams are evenly spaced apart from one another.

15. A lower side bed frame of a double-layer iron frame bed, comprising:

two transverse rods symmetrically parallel to each other in a front-and-rear direction, two longitudinal rods symmetrically parallel to each other in a left-and-right direction, four columns arranged vertically, two supporting feet, and a connecting rod for connecting the two supporting feet, wherein:

the two longitudinal rods and the two transverse rods form a rectangular frame, the four columns are respectively connected to four corners of the rectangular frame, each of the four columns comprises an upper column and a lower column that are configured be inserted together in an up-and-down direction, an upper end of the lower column comprises a joint section formed by reducing a diameter of the upper end of the lower column, the upper column is sleeved on the joint section, an end portion of each of the two longitudinal rods is fixedly connected to the lower column, an end surface of each of the two transverse rods is connected with a locking piece, the locking piece is configured to abut an outer side of the upper column and an outer side of the lower column, a first portion of the locking piece extending upwardly beyond an upper surface of each of the two transverse rods is locked with an upper bolt, the upper bolt enables the locking piece, the upper column, and the joint section to be locked together, a second portion of the locking piece extending downward beyond a lower surface of each of the two transverse rods is locked with a lower bolt, the lower bolt enables the locking piece and the lower column to be locked together, the two supporting feet are matched with the two transverse rods in a one-to-one correspondence, the two supporting feet are located below a middle position of the two transverse rods, the connecting rod is connected between the two supporting feet and is configured to pull the two supporting feet in a longitudinal direction of the lower side bed frame, end portions of the connecting rod are detachably insertion-connected with the two supporting feet, an end surface of the connecting rod comprises a U-shaped steel groove corresponding to a corresponding one of the two supporting feet, the U-shaped steel groove is clamped to the corresponding one of the two supporting feet, a tongue piece protrudes from a bottom surface of the U-shaped steel groove, the corresponding one of the two supporting feet comprises a buckle opening, and the tongue piece is configured to be inserted into the buckle opening.

* * * * *